US010771876B1

(12) United States Patent
Tikander et al.

(10) Patent No.: US 10,771,876 B1
(45) Date of Patent: Sep. 8, 2020

(54) HEADPHONES WITH ACOUSTICALLY SPLIT CUSHIONS

(71) Applicant: Apple Inc., Cupertino, CA (US)

(72) Inventors: Miikka O. Tikander, Sunnyvale, CA (US); Yacine Azmi, San Mateo, CA (US); Derek W. Wright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/126,290

(22) Filed: Sep. 10, 2018

Related U.S. Application Data

(60) Provisional application No. 62/565,458, filed on Sep. 29, 2017.

(51) Int. Cl.
*H04R 25/00* (2006.01)
*H04R 1/10* (2006.01)
*H04R 1/28* (2006.01)

(52) U.S. Cl.
CPC ..... *H04R 1/1008* (2013.01); *H04R 1/105* (2013.01); *H04R 1/1058* (2013.01); *H04R 1/1083* (2013.01); *H04R 1/288* (2013.01)

(58) Field of Classification Search
CPC .... H04R 1/1008; H04R 1/105; H04R 1/1058; H04R 1/1083; H04R 1/288; H04R 5/033; H04R 2201/10; H04R 2201/105
USPC ..... 2/434; 381/71.6, 372
See application file for complete search history.

(56) References Cited

U.S. PATENT DOCUMENTS

| | | | | |
|---|---|---|---|---|
| 6,938,277 | B2 * | 9/2005 | Lindahl | A61F 9/025 2/434 |
| 8,447,058 | B1 | 5/2013 | Sung et al. | |
| 8,467,539 | B2 | 6/2013 | Sapiejewski et al. | |
| 8,737,635 | B2 * | 5/2014 | Ambrose | H04R 1/1091 381/71.6 |
| 9,438,980 | B2 | 9/2016 | Huang et al. | |
| 2010/0119076 | A1 * | 5/2010 | Monk | A61F 11/14 381/71.6 |
| 2010/0128884 | A1 * | 5/2010 | Sapiejewski | H04R 1/1008 381/71.6 |
| 2015/0050436 | A1 | 2/2015 | Sereboff | |
| 2016/0119460 | A1 | 4/2016 | Shi et al. | |

(Continued)

FOREIGN PATENT DOCUMENTS

CN 105516842 4/2016

OTHER PUBLICATIONS

Non-Final Office Action for U.S. Appl. No. 16/126,333, dated Feb. 25, 2019, 13 pages.

(Continued)

*Primary Examiner* — Md S Elahee
(74) *Attorney, Agent, or Firm* — Kilpatrick Townsend & Stockton LLP

(57) ABSTRACT

Headphones are disclosed that include a first earcup assembly and a second earcup assembly. The headphones include a headband extending between the first and second earcup assemblies. The headband includes opposing ends attached to the first and second earcup assemblies, respectively. The first earcup assembly includes a first cushion coupled to an earcup. The first cushion includes a first portion that is acoustically open. The first cushion also includes a second portion acoustically sealed from the first portion.

20 Claims, 2 Drawing Sheets

(56) References Cited

U.S. PATENT DOCUMENTS

| | | | | |
|---|---|---|---|---|
| 2017/0164087 | A1* | 6/2017 | Kurtz | H04R 1/12 |
| 2017/0208387 | A1 | 7/2017 | Bearden | |

OTHER PUBLICATIONS

Final Office Action for U.S. Appl. No. 16/126,333, dated Jun. 7, 2019 16 pages.

* cited by examiner

HEADPHONES WITH ACOUSTICALLY SPLIT CUSHIONS

CROSS-REFERENCE TO RELATED APPLICATIONS

The present application claims the benefit of and priority to U.S. Provisional Application No. 62/565,458, filed Sep. 29, 2017, the entire contents of which are incorporated herein by reference for all purposes. This application is related to co-assigned and concurrently filed U.S. application Ser. No. 16/126,333 , entitled "HEADPHONES WITH TUNABLE DAMPENING FEATURES", which claims the benefit of and priority to U.S. Provisional Application No. 62/565,491, filed Sep. 29, 2017, the full disclosures of which are incorporated by reference herein in their entireties for all purposes.

FIELD

The described embodiments relate generally to various headphone dampening features. More particularly, the described embodiments relate to headphones having acoustically split or divided earcup cushions including acoustically sealed and open portions.

BACKGROUND

Over-ear or circumaural headphones have been in use for many years. Over-ear headphones typically include a headband and a pair of earcups attached to opposing ends of the headband which completely encircle or surround a user's ears when worn. Over-ear headphones can include earcups of a closed-back or open-back design. Closed-back earcups have acoustically sealed or substantially-sealed backs. Open-back earcups have backs acoustically open to ambient environment and noise surrounding the earcups. While closed-back earcups have backs which are acoustically sealed to the ambient environment and noise, the earcups can include one or more vents configured to provide barometric pressure relief.

Over-ear headphones with closed-back earcups typically provide good sound isolation because they are sealed or substantially sealed off from ambient noise. However, they can also have certain disadvantages due to the closed design of the earcups. In some closed-back headphones, undesirable or unwanted resonances (e.g., modes) may develop inside a front volume of each respective earcup (e.g., air volume encapsulated inside the earcup or between the earcup and a wearer's skull and/or ear). Further, standing waves can accumulate in the earcups (e.g., between a driver housing plate of the earcup and a wearer's skull and/or ear) which can degrade sound quality considerably. Typically, these standing waves occur in a 7-9 kHz range which can lead to undesirable or unwanted resonance in a frequency response of the headphones. As resonance frequency varies between wearers or users (e.g., due to anatomical differences), such unwanted resonance may be difficult to equalize with, for example, a digital signal processor (DSP) or graphic equalizer (EQ). As such, there remains a need for headphones with improved dampening features, and in particular, passive acoustic dampeners for closed-back, over-ear headphones.

SUMMARY

The present disclosure describes several improvements related to circumaural headphone designs including designs that have improved passive acoustic dampeners that are particularly useful for closed-back earcup headphones.

Headphones are disclosed that include a first earcup assembly and a second earcup assembly. The headphones include a headband extending between the first and second earcup assemblies. The headband includes opposing ends attached to the first and second earcup assemblies, respectively. The first earcup assembly includes a first cushion coupled to an earcup, the first cushion having at least a first portion and a second portion. The first portion is acoustically open. The second portion is acoustically sealed from the first portion.

In some embodiments, an acoustic seal separates the first cushion into the first and second portions. The acoustic seal may extend at an oblique angle relative to a lateral axis extending between front and back sides of the first earcup assembly. In other embodiments, the acoustic seal extends at a non-oblique angle relative to a lateral axis extending between front and back sides of the first earcup assembly. In some embodiments, the first portion is allows sound waves produced from a speaker of the first earcup assembly to propagate therethrough. In certain embodiments, the second portion is acoustically closed such that sound waves from a speaker of the first earcup assembly are prevented from entering the second portion. At least one of the first or second portions may include a foam material configured to provide dampening. In some embodiments, the first and second portions include semi-circular cross-sectional configurations. In some embodiments, the second portion is acoustically sealed from the first portion with an acoustic seal and wherein the acoustic seal comprises a non-planar surface. In yet other embodiments, a volume of the first portion is greater than a volume of the second portion. In other embodiments, a volume of the first portion is equal to a volume of the second portion. In still further embodiments, a volume of the first portion is less than a volume of the second portion. The first portion may include an acoustically transparent material. The first earcup assembly may include a closed-back and wherein the first portion forms a part of an effective front volume of the first earcup assembly when the first earcup assembly is positioned over a user's ear. In some embodiments, the first portion and the second portion each include foam, wherein the foam of the first portion is configured to be exposed to acoustic resonances and wherein the foam of the second portion is configured to be sealed from the acoustic resonances. In certain embodiments, the second portion includes an acoustic seal extends around an entire periphery of the second portion. In some embodiments, the second earcup assembly includes a second cushion coupled to a second earcup, the second cushion including a third portion that is acoustically open and a fourth portion that is acoustically sealed from the third portion.

An over-ear headphone earcup cushion is disclosed that includea a first portion and a second portion. The first portion is acoustically open. The second portion is acoustically sealed from the first portion. In some embodiments, the first portion may be acoustically open such that sound waves generated by a speaker can enter the first portion. The second portion may be sealed such that the sound waves are prevented from entering the second portion. In some embodiments, an acoustic seal separates the earcup cushion into the first portion and the second portion.

A method of forming a front volume of a closed-back, over-ear headphone is disclosed that comprises the steps of: acoustically opening a first portion of an earcup cushion to sound waves generated by a headphone speaker such that the first portion forms a part of the front volume when the headphone are worn by a user; and acoustically sealing a second portion from the first portion such that the sound waves are prevented from entering into the second portion of the earcup cushion and such that the second portion does not form part of the front volume.

Other aspects and advantages of the invention will become apparent from the following detailed description taken in conjunction with the accompanying drawings which illustrate, by way of example, the principles of the described embodiments.

DETAILED DESCRIPTION

The present disclosure describes various embodiments of headphones with improved dampening features and/or sensitivity and associated methods of dampening resonances developed inside closed-back, over-ear or circumaural headphones.

Certain details are set forth in the following description and in FIGS. 1-4B to provide a thorough understanding of various embodiments of the present disclosure. Other details describing well-known structures and systems often associated with headphones, headphone components, earcup assemblies, speakers, etc., however, are not set forth below to avoid unnecessarily obscuring the description of the various embodiments of the present disclosure.

Many of the details, dimensions, angles and other features shown in FIGS. 1-4B are merely illustrative of particular embodiments of the present disclosure. Accordingly, other embodiments can include other details, dimensions, angles and features without departing from the spirit or scope of the present disclosure. In addition, those of ordinary skill in the art will appreciate that further embodiments of systems described herein can be practiced without several of the details described below. Various embodiments of the present disclosure can also include structures other than those illustrated in the Figures and are expressly not limited to the structures shown in the Figures. Moreover, the various elements and features illustrated in the Figures may not be drawn to scale. In the Figures, identical reference numbers identify identical or at least generally similar elements, Headphone sensitivity refers to how effective a headphone converts an electrical signal into an acoustical signal. Sensitivity indicates how loud the headphones will sound at a given level from a source. For example, a more sensitive headphone will generally play louder than a less sensitive headphone at an equivalent volume setting. As a result, headphones with higher sensitivity generally consume less power relative to headphones with lower sensitivity.

Figure 1:
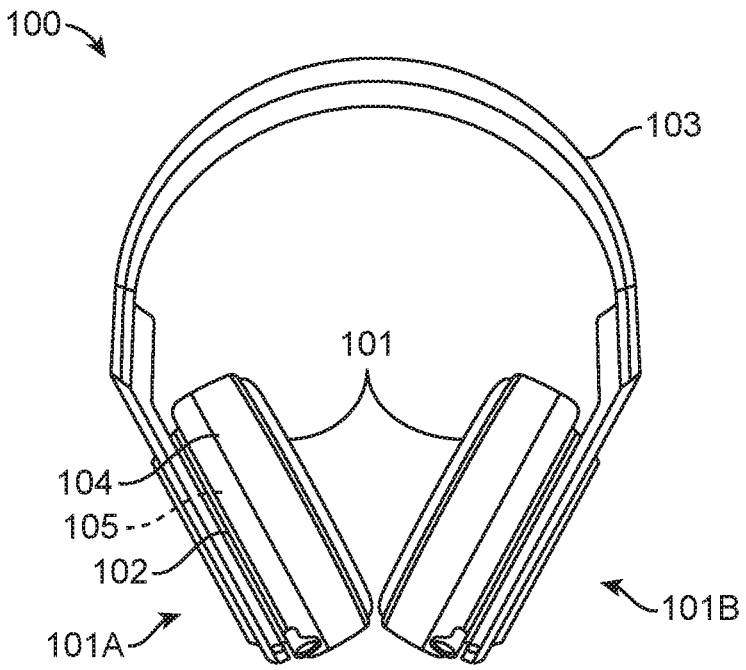
FIG. 1 shows an over-ear headphone with closed-back earcup assemblies configured in accordance with an embodiment of the present disclosure.

With reference to FIG. 1, an example closed-back, over-ear headphone 100 is illustrated. Headphone 100 includes earcup assemblies 101 (identified individually as a first earcup assembly 101*a* and a second earcup assembly 101*b*) attached to opposing ends of a headband 103. Each earcup assembly 101 includes an earcup 102 (e.g., shell, housing) and an earcup cushion 104 (e.g., earpad) extending around an entire periphery of earcup 102. Each earcup assembly 101 further includes a speaker 105 (e.g., driver, acoustical transducer) configured to produce sound waves. The speaker 105 can be positioned within the earcup 102. The earcup 102 can include one or more components assembled together (e.g., speaker grille, back shell, earcushion holder). In the closed-back design of headphone 100, when headphone 100 is worn by a user each earcup assembly 101 creates an acoustic seal around its respective ear isolating the user's ear from external noise while minimizing leakage of sound from its respective speaker.

Figure 2:
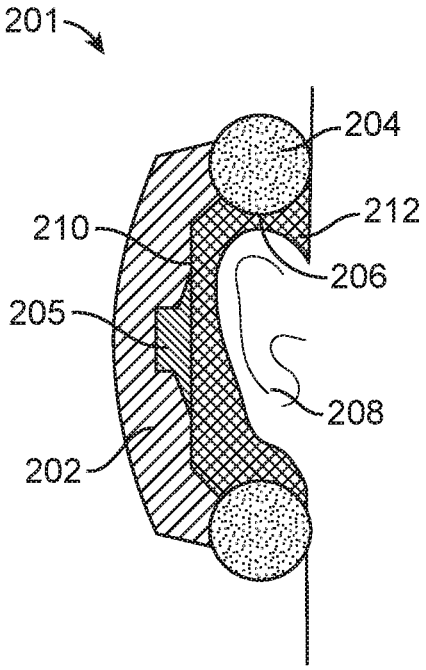
FIG. 2 shows a cross-sectional view of a portion of a conventional over-ear headphone earcup assembly with an acoustically sealed earcup cushion.

For closed-back, over-ear headphones, sensitivity is largely determined by front volume size (e.g., air volume encapsulated inside an earcup or between the earcup and a wearer's skull and/or ear). Generally, as front volume decreases, sensitivity increases. FIG. 2 illustrates a conventional earcup assembly 201 that can be provided with a closed-back, over-ear headphone (e.g., headphone 100). Earcup assembly 201 includes an earcup 202 with an acoustically sealed or closed earcup cushion 204 (e.g., by sealing earcup cushion 204 with an acoustically sealed layer 206 along an ear-facing periphery portion of cushion 204). Earcup cushion 204 is effectively "sealed" and acoustically closed (e.g., to sound waves produced from a speaker 205 in earcup 202). When worn over a user's ear 208, a front volume (e.g, shown in cross hatch) is effectively limited to air volume inside earcup assembly 201 bounded by a front side or surface 210 of earcup 202, cushion 204, and the user's ear 208 and/or skull 212. When earcup cushion 204 is acoustically sealed or closed, walls of cushion 204 can become acoustically reflective resulting in unwanted resonances (e.g., modes) inside the front volume. A traditional solution to mitigate or reduce such resonances is to provide acoustically open earcup cushions (e.g., on an ear-facing side of an earcup) to dampen such resonances.

Figure 3:
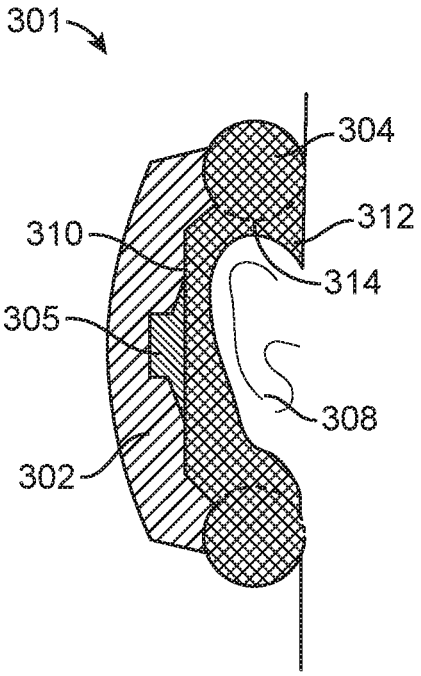
FIG. 3 shows a cross-sectional view of a portion of another conventional over-ear headphone earcup assembly with an acoustically open earcup cushion.

FIG. 3 illustrates another conventional earcup assembly 301 that can be provided with a conventional closed-back, over-ear headphone (e.g., headphone 100). Earcup assembly 301 includes an earcup 302 with an acoustically open earcup cushion 304. In contrast to earcup 202, earcup cushion 304 includes an acoustically transparent or open layer 314 (e.g., identified in broken lines along an ear-facing periphery portion of cushion 304). Earcup cushion 304 is effectively "open" and exposed acoustically (e.g., to sound waves produced from a speaker 305 in earcup 302) via layer 314. However, an outer or exterior surface portion 315 exposed to or facing ambient environment (e.g., opposite ear-facing periphery portion) is acoustically sealed such that earcup cushion 304 is acoustically sealed from ambient noise. Earcup cushion 304 can include cushion material (e.g., foam) to provide dampening of unwanted resonances and comfort for a user when worn. However, when worn over a user's ear 308, a front volume (e.g., shown in cross hatch) bounded by a front side or surface 310 of earcup 302 and the user's ear 308 and/or skull 312 is effectively expanded to include a volume of acoustically open earcup cushion 304. Thus, by acoustically opening cushion 304 to provide dampening of resonances (e.g., via cushion material), the front volume is effectively increased. Increasing the front volume in this manner can decrease headphone sensitivity considerably relative to headphones with acoustically sealed earcup cushions (e.g., earcup cushion 204). Consequently, there remains a need for closed-back, over-ear headphones that enable dampening unwanted resonances while minimizing or decreasing sensitivity loss (e.g., due to increased front volume size).

Figure 4A:
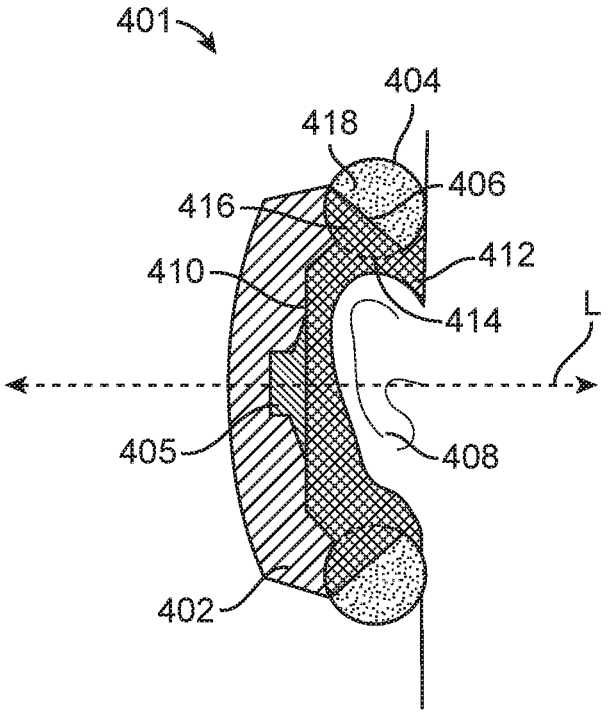
FIG. 4A shows a cross-sectional view of an earcup assembly worn over a user's ear and having split earcup cushions with acoustically sealed and open portions in accordance with an exemplary embodiment of the present disclosure.
Figure 4B:
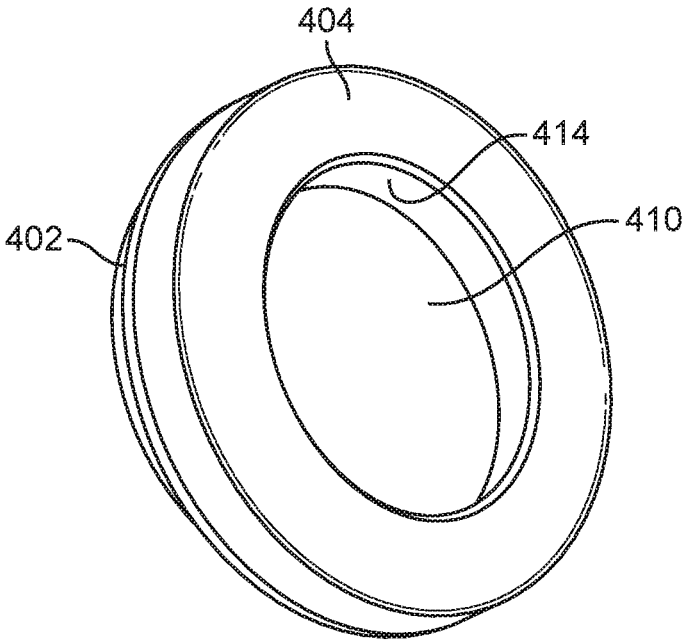
FIG. 4B shows a front perspective view of the earcup assembly of FIG. 4A.

With reference to FIGS. 4A-4B, an earcup assembly 401 is shown that is configured in accordance with embodiments of the present disclosure. Earcup assembly 401 can be used with closed-back, over-ear headphones (e.g., headphone 100) and replaces conventional earcup assemblies (e.g., earcup assemblies 201 and 301). It should be understood that the figures illustrate only one of a pair of left and right ear earcup assemblies of a headphone. Thus, each of the features described in reference to earcup assembly 401 illustrated in FIG. 4A and FIG. 4B should be understood as applying to the other earcup assembly of the pair.

Earcup assembly 401 includes an earcup 402 with an acoustically "split" earcup cushion 404 (e.g., earpad) extending around an entire periphery of earcup 402. Earcup cushion 404 includes a first portion 416 (e.g., material, layer, surface) that is acoustically open. Earcup cushion 404 also includes a second portion 418 (e.g., material, layer, surface) that is acoustically sealed from first portion 416. First portion 416 includes an acoustically transparent or open portion 414 (e.g., identified in broken lines along an ear-facing periphery portion of cushion 404). Open portion 414 can be a surface, boundary, interface, coating, or layer. For example, in some embodiments, acoustically open portion 414 extends along a portion of or an entire inner diameter surface of earcup cushion 404. Additionally, earcup cushion 404 includes an acoustic sealing portion 406. Rather than extending along a periphery of earcup cushion 404, acoustic sealing portion 406 extends through or across an inner portion (e.g., body portion) of earcup cushion 404. Acoustic sealing portion 406 can be a surface, boundary, interface, coating, or layer. Acoustic sealing portion 406 may be integrally formed or form a portion of (e.g., as layer or surface) of first portion 416, second portion 418, or both. In other embodiments, sealing portion 406 is separately formed and configured to be coupled or otherwise mechanically joined to first portion 416, second portion 418, or both. Acoustic sealing portion 406 provides a barrier configured to prevent sound waves from passing therethrough. Earcup cushion 404 is effectively split into acoustically open and closed portions (e.g., first and second portions 416, 418).

In such a configuration, only the first portion 416 forms a part of a front volume (e.g., shown in cross hatch) of earcup assembly 401 (e.g., bounded by a front side or surface 410 of earcup 402, a user's ear 408 and/or skull 412, and first portion 416) when the earcup assembly 401 is worn or positioned over a user's ear. The front volume of earcup assembly 401 is relatively larger than earcup assembly 201 (where earcup cushion 204 is completely acoustically sealed) but relatively smaller than earcup assembly 301 (where earcup cushion 304 is completely acoustically open). Acoustically split cushions help maintain headphone sensitivity while also providing dampening via the acoustically open portion of the earcup cushion.

First portion 416 (e.g., shown in cross hatch) of earcup cushion 404 is exposed or open acoustically (e.g., to sound waves produced from a speaker 405) via, for example, acoustically open portion 414. Acoustically open portion 414 can be planar or non-planar (e.g., convex, concave, wavy, S-shaped). Second portion 418 is acoustically closed or sealed (e.g., to the sound waves) from first portion 416 via, for example, acoustic sealing portion 406. In some embodiments, acoustic sealing portion 406 separates a total volume of earcup cushion 404 into the first and second portions 416, 418 such that sealing portion 406 forms a perimeter portion of each of the first and second portions 416, 418. As described above, sealing portion 406 can also be an interface or boundary portion between first and second portions 416, 418. In other embodiments, earcup cushion 404 can include other buffer or intermediary layers between first and second portions 416, 418.

While acoustic sealing portion 406 is illustrated as a single layer, in other embodiments, acoustic sealing portion 406 includes multiple layers (e.g., two or more layers). Acoustic sealing portion can include rubber, silicon, or other suitable layers configured to seal or block sound waves from entering or propagating into second portion 418. Acoustic sealing portion 406 can be planar or non-planar (e.g., convex, concave, wavy, S-shaped). Further, while illustrated as extending at an oblique angle relative to a lateral axis L (e.g., extending between front and back sides of earcup 402), in other embodiments, acoustic sealing portion 406 extends at a non-oblique angle (e.g., parallel or perpendicular) relative to lateral axis L. In yet further embodiments, a first portion of acoustic sealing portion 406 extends at an oblique angle while a second portion extends at a non-oblique angle relative to lateral axis.

The first and second portions 416, 418 can be of different size ratios relative to each other and/or a total volume of earcup cushion 404. In some embodiments, a volume of first portion 416 is greater than a volume of second portion 418. In other embodiments, a volume of first portion 416 is less than a volume of second portion 418. In yet further embodiments, a volume of first portion 416 is equal or about equal to a volume of second portion 418. Ratios or sizes of first and second portions 416, 418 can be optimized or selected to improve or maximize a headphone's sensitivity (e.g., minimizing front volume size) while providing sufficient dampening (e.g., of unwanted resonances) via acoustically split earcup cushions 404 relative to a headphone with conventional earcup assemblies and earcup cushions (e.g., earcup assemblies 201 and 301). First and second portions 416, 418 can have semi-circular cross-sectional configurations. In other embodiments, first and second portions can have other cross-sectional configurations (e.g., rectangular, trapezoidal).

The first and second portions 416, 418 can include or be filled with same or similar materials. For example, earcup cushion 404 (e.g., both first and second portions 416, 418) can include cushion material (e.g., porous foam or other suitable materials) to provide dampening of unwanted resonances (e.g., via first portion 416) and comfort for a user when headphones with earcup assemblies 401 are worn. In other embodiments, first and second portions 416, 418 can include or be filled with different or dissimilar materials. For example, first portion 416 can include a porous foam (e.g., configured to provide dampening) while second portion 418 can include a closed-cell foam. As sound waves are blocked or prevented from entering second portion 418, in some embodiments, second portion 418 does not need to include materials capable of providing dampening.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited. except as by the appended claims.

References throughout the foregoing description to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the present invention may be combined in any suitable manner in one or more embodiments. One skilled in the relevant art will recognize that the present invention can be practiced without one or more of the specific features or advantages of a particular embodiment. In other instances, additional features and advantages may be recognized in certain embodiments that may not be present in all embodiments of the present invention.

Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

What is claimed is:

1. A headphone, comprising:

a first earcup assembly including a first acoustically split cushion coupled to a first earcup, the first acoustically split cushion including a first portion comprising porous foam that is acoustically open and a second portion comprising closed foam that is acoustically sealed from the first portion;

a second earcup assembly; and a headband extending between the first and second earcup assemblies, the headband including first and second opposing ends attached to the first and second earcup assemblies, respectively.

2. The headphone of claim 1, wherein an acoustic seal separates the first cushion into the first and second portions.

3. The headphone of any of claim 2, wherein the acoustic seal extends at an oblique angle relative to a lateral axis extending between front and back sides of the first earcup assembly.

4. The headphone of any of claim 2, wherein the acoustic seal extends at a non-oblique angle relative to a lateral axis extending between front and back sides of the first earcup assembly.

5. The headphone of claim 1, wherein the first portion extends along an inner periphery of the first cushion and allows sound waves produced from a speaker of the first earcup assembly to propagate therethrough.

6. The headphone of claim 1, wherein the second portion extends along an outer periphery of the first cushion and is acoustically closed such that sound waves from a speaker of the first earcup assembly are prevented from entering the second portion.

7. The headphone of claim 1, wherein the first portion comprising porous form extends along an inner periphery of the first cushion and the second portion comprising closed foam extends along an outer periphery of the first cushion.

8. The headphone of claim 1, wherein the first and second portions comprise semi-circular cross-sectional configurations.

9. The headphone of claim 1, wherein the second portion is acoustically sealed from the first portion with an acoustic seal and wherein the acoustic seal comprises a non-planar surface.

10. The headphone of claim 1, wherein a volume of the first portion is greater than a volume of the second portion.

11. The headphone of claim 1, wherein a volume of the first portion is equal to a volume of the second portion.

12. The headphone of claim 1, wherein a volume of the first portion is less than a volume of the second portion.

13. The headphone of claim 1, wherein the first portion comprises an acoustically transparent material.

14. The headphone of claim 1, wherein the first earcup assembly comprises a closed-back and wherein the first portion forms a part of an effective front volume of the first earcup assembly when the first earcup assembly is positioned over a user's ear.

15. The headphone of claim 1, wherein the first portion and the second portion each comprise foam, wherein the foam of the first portion is configured to be exposed to acoustic resonances and wherein the foam of the second portion is configured to be sealed from the acoustic resonances.

16. The headphone of claim 1, wherein the second portion includes an acoustic seal extending around an entire periphery of the second portion.

17. The headphone of claim 1, wherein the second earcup assembly includes a second cushion coupled to a second earcup, the second cushion including a third portion that is acoustically open and a fourth portion that is acoustically sealed from the third portion.

18. An acoustically split over-ear headphone earcup cushion, comprising:

a first portion of the earcup cushion comprising porous foam that is acoustically open; and a second portion of the earcup cushion comprising closed foam that is acoustically sealed from the first portion;

wherein the ear cup cushion is sized and shaped to fit over and around a user's ear.

19. The earcup cushion of claim 18, wherein an acoustic seal separates the earcup cushion into the first portion and the second portion.

20. The earcup cushion of claim 19, wherein the acoustic seal comprises at least one of a coating, interface, or surface.

* * * * *